US008896209B2

(12) United States Patent
Yao et al.

(10) Patent No.: US 8,896,209 B2
(45) Date of Patent: Nov. 25, 2014

(54) PROGRAMMED START CIRCUIT FOR BALLAST

(75) Inventors: Gang Yao, Mayfield Heights, OH (US); Bo Zhang, Shanghai (CN); Ting Zhang, Shanghai (CN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/262,139

(22) PCT Filed: May 9, 2011

(86) PCT No.: PCT/CN2011/000797

§ 371 (c)(1), (2), (4) Date: Sep. 29, 2011

(87) PCT Pub. No.: WO2012/151712

PCT Pub. Date: Nov. 15, 2012

(65) Prior Publication Data

US 2014/0055033 A1 Feb. 27, 2014

(51) Int. Cl.

| | |
|---|---|
| ***H05B 37/02*** | (2006.01) |
| ***H05B 41/16*** | (2006.01) |
| ***H05B 41/34*** | (2006.01) |
| ***H05B 41/282*** | (2006.01) |

(52) U.S. Cl.

CPC ..... *H05B 37/02* (2013.01); *H05B 41/2828* (2013.01)

USPC ..... 315/107; 315/276; 315/255; 315/219

(58) Field of Classification Search

CPC ..... H05B 37/02

USPC ..... 315/276, 107, 219, 224, 225, 226, 240, 315/209 R

See application file for complete search history.

(56) References Cited

U.S. PATENT DOCUMENTS

| | | | | |
|---|---|---|---|---|
| 5,124,619 | A * | 6/1992 | Moisin et al. | 315/219 |
| 5,170,099 | A | 12/1992 | Ueoka et al. | |
| 5,438,243 | A | 8/1995 | Kong | |
| 5,512,801 | A | 4/1996 | Nilssen | |
| 5,731,667 | A | 3/1998 | Luchetta et al. | |
| 5,744,915 | A | 4/1998 | Nilssen | |
| 5,834,906 | A | 11/1998 | Chou et al. | |
| 5,877,592 | A | 3/1999 | Hesterman et al. | |
| 5,920,155 | A | 7/1999 | Kanda et al. | |
| 5,959,408 | A | 9/1999 | Steel et al. | |
| 5,982,113 | A | 11/1999 | Crouse et al. | |
| 6,236,168 | B1 | 5/2001 | Moisin | |
| 6,366,031 | B2 | 4/2002 | Klien | |
| 6,417,630 | B1 * | 7/2002 | Simpelaar | 315/291 |
| 6,720,739 | B2 | 4/2004 | Konopka | |
| 6,809,477 | B2 | 10/2004 | Soules et al. | |
| 7,193,368 | B2 | 3/2007 | Chen et al. | |

(Continued)

OTHER PUBLICATIONS

Written Opinion, International Application No. PCT/CN2011/000797, Feb. 2, 2012.

(Continued)

*Primary Examiner* — Douglas W Owens
*Assistant Examiner* — Wei Chan
(74) *Attorney, Agent, or Firm* — Fay Sharpe LLP

(57) ABSTRACT

A programmed start ballast circuit is presented having a mode control circuit to selectively switch an inverter output load to control operation for cathode preheating, step dimming and/or anti-arcing operation.

20 Claims, 3 Drawing Sheets

| MODE | S1 | INVERTER OUTPUT POWER | CATHODE PREHEATING |
|---|---|---|---|
| 1 | CLOSED | HIGH | NO |
| 2 | OPEN | LOW | YES |

(56) References Cited

U.S. PATENT DOCUMENTS

| | | | | |
|---|---|---|---|---|
| 7,288,901 | B1 | 10/2007 | Yu et al. | |
| 7,327,101 | B1 | 2/2008 | Chen et al. | |
| 7,468,586 | B2 | 12/2008 | Yu et al. | |
| 7,733,028 | B2 | 6/2010 | Chen et al. | |
| 7,830,096 | B2 * | 11/2010 | Chen et al. | 315/224 |
| 8,084,953 | B2 * | 12/2011 | Xie et al. | 315/219 |
| 8,274,234 | B1 * | 9/2012 | Xiong | 315/219 |
| 8,659,233 | B2 | 2/2014 | Nerone et al. | |
| 2003/0160554 | A1 | 8/2003 | Soules et al. | |
| 2003/0160571 | A1 * | 8/2003 | Moisin | 315/224 |
| 2004/0051475 | A1 | 3/2004 | Griffin | |
| 2004/0070324 | A1 | 4/2004 | Lisitsyn | |
| 2004/0090800 | A1 * | 5/2004 | Moisin | 363/17 |
| 2004/0190314 | A1 * | 9/2004 | Yoshida | 363/65 |
| 2005/0067973 | A1 | 3/2005 | Beij et al. | |
| 2009/0108766 | A1 * | 4/2009 | Chen et al. | 315/255 |
| 2009/0115340 | A1 * | 5/2009 | Chen et al. | 315/225 |
| 2010/0213864 | A1 * | 8/2010 | Xie et al. | 315/276 |
| 2012/0182772 | A1 * | 7/2012 | Hosokawa et al. | 363/56.12 |
| 2013/0099572 | A1 * | 4/2013 | Norrga | 307/43 |

OTHER PUBLICATIONS

International Search Report, International Application No. PCT/CN2011/000797, Feb. 2, 2012.

CN Application No. 201180070742.6, Office Action Issued Jul. 28, 2014 (English Translation Appended).

* cited by examiner

| MODE | S1 | INVERTER OUTPUT POWER | CATHODE PREHEATING |
|---|---|---|---|
| 1 | CLOSED | HIGH | NO |
| 2 | OPEN | LOW | YES |

| MODE | S1 | INVERTER OUTPUT POWER | CATHODE PREHEATING |
|---|---|---|---|
| 1 | CLOSED | HIGH | NO |
| 2 | OPEN | LOW | YES |

PROGRAMMED START CIRCUIT FOR BALLAST

CROSS-REFERENCE TO RELATED APPLICATIONS

This application is a national stage entry of international application number PCT/CN2011/000797, having international filing date of May 9, 2011, the entirety of which is hereby incorporated by reference as if fully set forth herein.

BACKGROUND OF THE INVENTION

The present application is directed to lighting devices, and more particularly to improved program start ballast circuits for discharge lamps. Electronic ballasts are used to power fluorescent lamps, high-intensity discharge lamps, and the like, and typically include an inverter to generate lamp power. Electronic ballasts may be started using one of several starting techniques, including "instant" start, "rapid" start, and "programmed" start. The instant start technique starts a lamp without preheating a cathode associated therewith, which results in low cost in ballast design but the lamp cathodes can be degraded rapidly due to the violent nature of the starting method. Rapid start ballasts start the ballast and heat the cathode concurrently, resulting in a relatively long start time while mitigating the adverse effects of a cold start on the lamp's cathode. Programmed start ballasts apply a relatively low output voltage initially, which is not high enough to begin gas discharge, while the lamp filaments or cathodes are preheated at a relatively high level for a limited period of time. After the cathodes are preheated, a moderately high voltage is applied to ignite the lamp and the filament heating power is discontinued. Conventional programmed start ballasts open or short a preheat circuit to stop the preheating power (cathode cut-off). This approach tends to be costly in practice, particularly for ballasts that power multiple lamps. Accordingly, there is a need for improved programmed start ballasts.

Step-dimming ballasts have been developed to allow energy savings by users selecting one of two levels of fluorescent lamp illumination. Step dimming has been previously accomplished by dedicated dimming circuitry that increases the frequency of the ballast inverter to lower the output power, or by the provision of multiple inverters in the ballast, with one inverter being shut down while the other keeps working for dimmed operation. These dimming solutions, however, require additional circuit components and can be costly in terms of circuit area and cost. Thus, there is a need for improved step dimming ballasts.

Another problem with lamp ballasts relates to arcing. Electronic ballasts are generally equipped to provide high output voltages in order to ignite gas discharge lamps. As a result, however, these ballasts may be exposed output arcing fault conditions, such as when a failed lamp is while AC power is applied to the ballast, or when the lamp electrical connection with the ballast output is intermittent. Such arcing is undesirable and may damage the ballast and/or the lamp, lamp holder. Thus, it is desirable to provide improved electronic ballasts that can quickly extinguish detected arcs without damage to the ballast or the lamp holder.

BRIEF DESCRIPTION OF THE INVENTION

Improved ballasts are disclosed with improved preheat circuitry that selectively adds an impedance network to the inverter circuit so that inverter output is low enough to meet the preheat requirement during preheat period, and can also provide step dimming and/or are extinguishment. The disclosed circuitry provides any or all these features without significant cost or space increase.

In accordance with one or more aspects of the disclosure, a programmed start ballast circuit is provided, which includes a rectifier and a DC circuit that optionally includes a DC to DC converter which drives an inverter to power one or more light sources. The inverter includes first and second capacitances coupled in series between the output terminals of the DC circuit and joined with one another at a first intermediate node, as well as first and second switching devices in series between the first and second rectifier output terminals joined together at a second intermediate node. A first transformer is provided, having a first primary winding coupled between the second intermediate node and a third intermediate node of the inverter, along with a third capacitance coupled in parallel with the first primary. A primary winding of a second transformer is coupled between the first and third intermediate nodes, and a mode control circuit operates to selectively couple the third intermediate node with one of the first and second DC circuit output terminals in a first mode in order to reduce a voltage potential across the second primary winding. In a second mode, the mode control circuit disconnects the third intermediate node from the second DC output terminal. In this manner, the ballast operates at a high power output in the first mode for normal lighting operation, and reduces the output power level in the second mode for preheating, step dimming and/or for extinguishing detected arcs.

In certain embodiments, the mode control circuit reduces the second primary winding voltage potential to zero in the first mode to reduce the inverter resonant frequency.

In certain embodiments, the mode control circuit includes a fourth capacitance and a switching device coupled in series between the third intermediate node and the second DC output terminal with the mode control switching device conductive in the first mode and non-conductive in the second mode. In certain embodiments, the second DC output terminal is grounded.

In certain embodiments, the second transformer provides one or more secondary windings to heat light sourced cathode(s) when the primary is energized, and a preheat timer provides a signal to hold the mode control circuit in the second mode for a predetermined preheat time following powerup of the ballast circuit, and then allows the mode control circuit to switch to the first mode after the predetermined preheat time to end preheating of the light source cathode.

In certain embodiments, the mode control circuit switches from the first mode to the second mode for dimmed operation in response to a dimming signal after the predetermined preheat time.

In certain embodiments, the mode control circuit switches from the first mode to the second mode for a predetermined arcing time to extinguish a detected arcing condition in response to an arcing detect signal after the predetermined preheat time, and then switches back to the first mode.

In accordance with further aspects of the disclosure, a programmed start ballast circuit is provided, which includes an inverter having a resonant circuit that produces an AC output to power one or more light sources at a first output level in a first mode, and powers the light source(s) at a second lower output level in a second mode. The ballast also includes a preheat circuit that provides heat to one or more light source cathodes in the second mode, as well as a mode control circuit with a switching device that operates according to a mode control input to set the inverter mode using two equal potential nodes to change the impedance of the inverter resonant circuit.

In certain embodiments, the ballast further includes a preheat timer that provides a signal to hold the mode control circuit in the second mode for a predetermined preheat time following power up of the ballast for cathode preheating, and to allow the mode control circuit to switch to the first mode after the predetermined preheat time to end cathode preheating.

In certain embodiments, the mode control circuit is selectively operative in response to a dimming control signal to switch from the first mode to the second mode for dimmed operation.

In certain embodiments, the mode control circuit operates in response to an arcing detect signal to switch to the second mode for a predetermined arcing time to extinguish a detected arcing condition, and to thereafter switch from the second mode to the first mode.

DETAILED DESCRIPTION OF THE PREFERRED EMBODIMENTS

Figure 1:
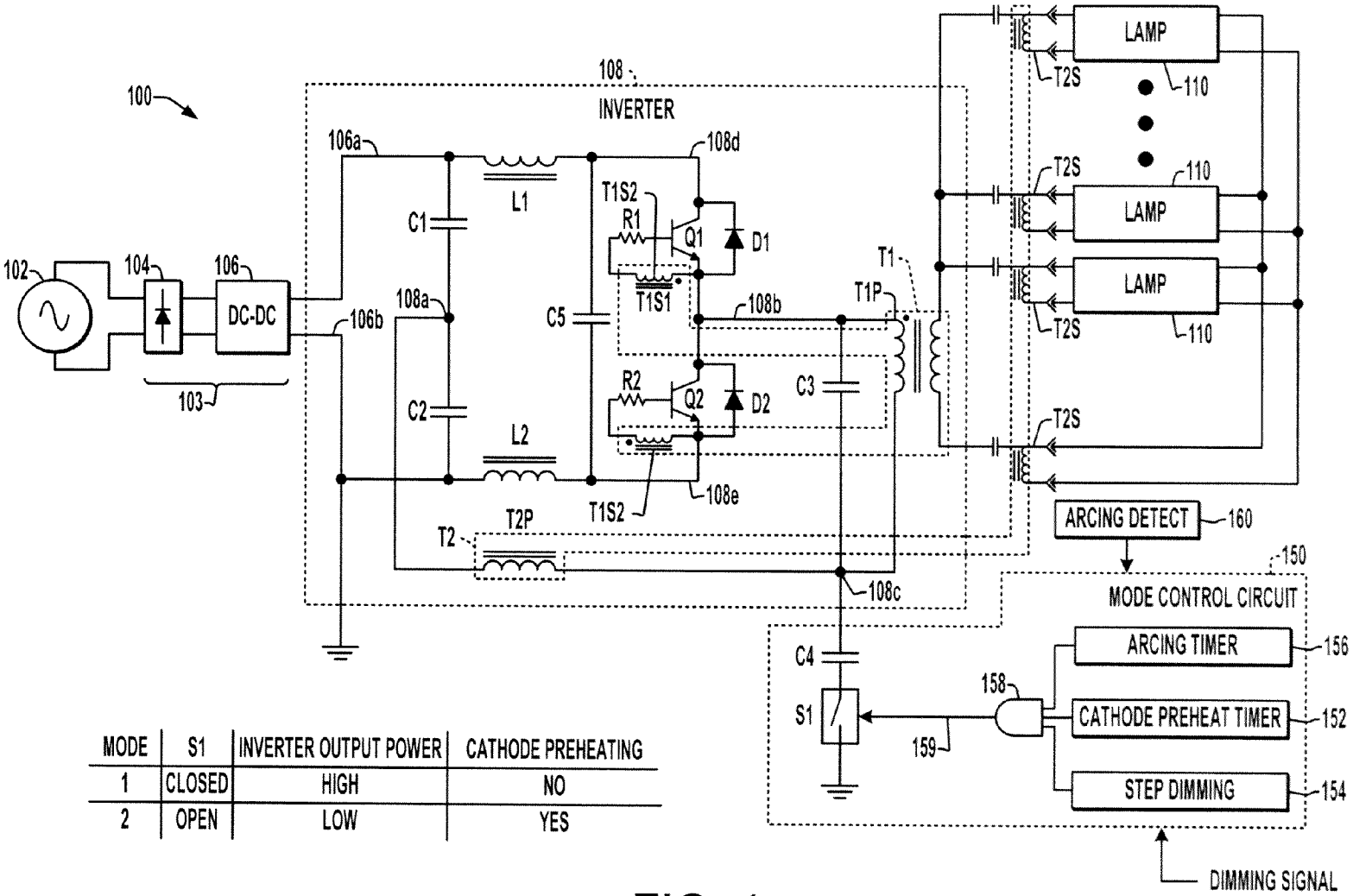
FIG. 1 is a schematic diagram illustrating an exemplary program start ballast for powering one or more fluorescent lamps, including a mode control circuit that selectively changes an inverter resonant frequency for cathode preheating, step dimming and/or for extinguishing detected arcs in accordance with one or more aspects of the present disclosure.

Referring now to the drawings, like reference numerals are used to refer to like elements throughout and the various features are not necessarily drawn to scale.

FIG. 1 shows a programmed start ballast circuit 100 with a DC circuit 103 that receives input AC power from a single or multiphase power source 102 and generates rectified DC power via a rectifier circuit 104, which can be a full wave rectifier bridge, a half-wave rectifier, or any other form of rectification circuit that converts input AC power into rectified DC power. In certain embodiments, the rectified DC power from the rectifier circuit 104 is provided to a passive power factor correction circuit (not shown), which provides a DC output. In other embodiments, the rectifier 104 provides a DC output directly to an inverter circuit 108. The ballast circuit 100, moreover, may include one or more filtering circuits (not shown) to filter incoming AC power and/or intermediate DC voltages or currents. In the illustrated embodiment a, DC to DC converter circuit 106 is provided which has DC input terminals coupled with the rectifier output terminals to receive the rectified DC from the rectifier 104, and the DC-DC circuit 106 provides a DC output at first and second DC output terminals 106*a* and 106*b*, respectively. Thus, in this embodiment, the terminals 106*a* and 106*b* provide DC outputs of the DC circuit 103.

An inverter circuit 108 is coupled to the output terminals 106*a* and 106*b* of the DC to DC converter 106, and converts the DC output to produce an AC output to power one or more light sources 110, such as fluorescent lamps, high intensity discharge lamps, etc. The inverter 108 in the illustrated embodiment includes first and second input capacitors C1 and C2 coupled together at a first intermediate node 108*a*, where the capacitors C1 and C2 are of equal capacitance in certain embodiments such that the voltage at node 108*a* is half the input DC voltage provided by the converter 106 (e.g., $V_{DC}/2$).

The inverter 108 is a self-oscillating type, which operates by alternating actuation of first and second switching devices Q1 and Q2, respectively, which are coupled in series between the DC-DC converter output terminals 106*a* and 106*b*, where the illustrated embodiment includes first and second DC link inductors L1 and L2 connected in the upper and lower DC branches of the inverter circuit 108, respectively, with a capacitance C5 coupled in parallel with the switching devices Q1 and Q2 between internal inverter nodes 108*d* and 108*em*, where the inductances L1 and L2 may be wound on a common core in certain embodiments.

Q1 and Q2 are joined with one another at a second inverter intermediate node 108*b* that operates as an AC output terminal of the inverter 108. This node 108*b* is connected to a first (upper) terminal of a primary winding T1P of a first transformer T1, whose secondary winding drives the lamp outputs for powering the lamps 110. The primary T1P has a second (lower) terminal coupled with a third intermediate node 108*c* of the inverter 108, and a third capacitance C3 is connected in parallel with the primary T1P between the second and third intermediate nodes 108*b* and 108*c*.

The ballast 100 includes a second transformer T2 with a second primary winding T2P coupled between the first and third intermediate nodes 108*a* and 108*c*. In practice, the impedance of the second primary winding T2P is in series with the first primary T1P during full power operation of the inverter 108, where the connection of this impedance T2P in the inverter resonant circuit sets the resonance to a low frequency for high inverter output power (e.g., 100% rated power for a given design).

A mode control circuit 150 is provided in the ballast 100, which operates in one of two modes, and effectively changes the inverter resonant circuit impedance to set the frequency and hence the output power level according to the operational mode. This circuit 150 in the illustrated embodiment of FIG. 1 includes a capacitor C4 and a switching device S1 coupled in series with one another between the third intermediate node 108*c* and the second DC output terminal 106*b* of the DC to DC converter circuit 106. The switching device SI can be any form of electrical switch, including without limitation a transistor, relay, FET, etc., which is conductive (e.g., closed) in the first mode and non-conductive (e.g., open) in the second mode. In this embodiment, moreover, operation of the mode control switch S1 in the first mode coupling the third intermediate node 108*c* with the second DC output terminal 106*b* of the DC to DC converter circuit 106 via the capacitor C4. This reduces the voltage potential across the winding T2P. In the second mode, the control circuit 150 disconnects the third intermediate node 108*c* from the second DC-DC output terminal 106*b* (S1 open or non-conductive), which increases the effective impedance of the inverter resonant circuit, thereby increasing the inverter operating frequency and lowering the output power applied to the lamp(s) 110.

As seen in the embodiment of FIG. 1, the mode control circuit capacitor C4 is coupled between the third intermediate node 108*c* and the switching device S1, and S1 is coupled between C4 and the second DC-DC output terminal 106*b*. In addition, the second DC-DC output terminal 106*b* in this example is connected to a circuit ground.

In the illustrated example, moreover, the closure of switch S1 (in the first mode) effectively reduces the voltage potential across T2P to zero since connection of C4 to the lower DC output rail terminal 106*b* grounds C4, causing the potentials at nodes 108*a* and 108*c* to equalize at approximately $V_{DC}/2$. The illustrated embodiment thus advantageously uses two nodes of the inverter 108 that reach equilibrium at the same voltage to effectively turn off the primary winding current in T2P for changing the output level of the inverter 108. This is used in various embodiments for performing one or more functions, such as step dimming, arcing control, and/or cathode preheating during programmed starting.

The illustrated ballast 100, cathode preheating is done by energizing the primary winding T2P, where the second transformer in certain embodiments includes one or more secondary windings T2S which are located so as to heat a cathode of the at least one light source 110 when a voltage is applied across the second primary winding T2P. As seen in FIG. 1, a separate secondary T2S is provided for each of the first ends of the lamps 110, and a single secondary is provided for the power return connections from second ends of the lamps 110, although other configurations of preheating secondary windings are possible. The ballast 100 in this case also includes a preheat timer 152 that starts a timing cycle when power is applied to the ballast 100. During this preheating time period, the timer 152 provides a signal to hold the mode control circuit 150 in the second mode for a predetermined preheat time. During this time, the switch S1 is held open, whereby the current provided through the output transformer primary T1P conducts through the second transformer primary T2P and thus preheating current flows through the preheating secondary windings T2S to cause preheating of the light source cathodes. After the predetermined preheat time has elapsed, the preheat timer 152 changes its output signal to allow the mode control circuit 150 to switch to the first mode to end preheating of the light source cathode by closing the switch S1 to reduce the voltage across T2P to zero.

In the illustrated embodiment, moreover, the mode control circuit 150 provides other functions via actuation of the switch S1. To accomplish this, the switch S1 is controlled by a mode signal 159 provided by an OR gate 158 or other gating circuitry 158 having logical OR functionality. In this embodiment, the cathode preheat timer circuit 152 applies its output signal as one input to the gating circuitry 158.

The ballast 100 of FIG. 1 also provides step dimming capabilities, where the mode control circuit 150 receives a dimming signal from a suitable source, such as an external dimming control device, or from circuitry within the ballast 100 that provides for dimming operation at specific times, or according to a program stored in the ballast 100 to operate a specific time after powerup, or based on a user input or control, etc. A step dimming circuit 154 in certain embodiments provides an output signal as a second input to the OR gating circuitry 158 to control the mode of the circuit 150. In this case, the mode control circuit 150 is selectively operative in response to a dimming signal after the predetermined preheat time to switch from the first mode to the second mode for dimmed operation.

The exemplary ballast 100 of FIG. 1 also includes an arcing detection circuit 160 that is operatively coupled to sense or detect arcing conditions, such as may occur where the connection of a lamp holder is not properly connected to a terminal of the lamp 110. Any suitable arc detection circuitry and/or logic 160 may be used by which an arc detection signal is generated. In the embodiment of FIG. 1, the arcing detection signal from circuit 160 starts an arcing timer 156. The timer 156 switches the mode of the control circuit 150 from the first mode to the second mode for a predetermined arcing time to lower the output power provided by the inverter 108 in order to allow the detected arcing condition to be extinguished. After the arcing timer has elapsed, the timer circuit 156 changes its output signal to switch from the second mode back to the first mode.

In embodiments that provide cathode preheating via the mode control circuit 150, the preheating operation can be set to take precedence over anti-arcing or dimming control, so that the cathode preheating will occur (in the second mode) for its predetermined time period independent of the signal conditions of the anti-arcing timer 156 and the dimming circuit 154.

Figure 2:
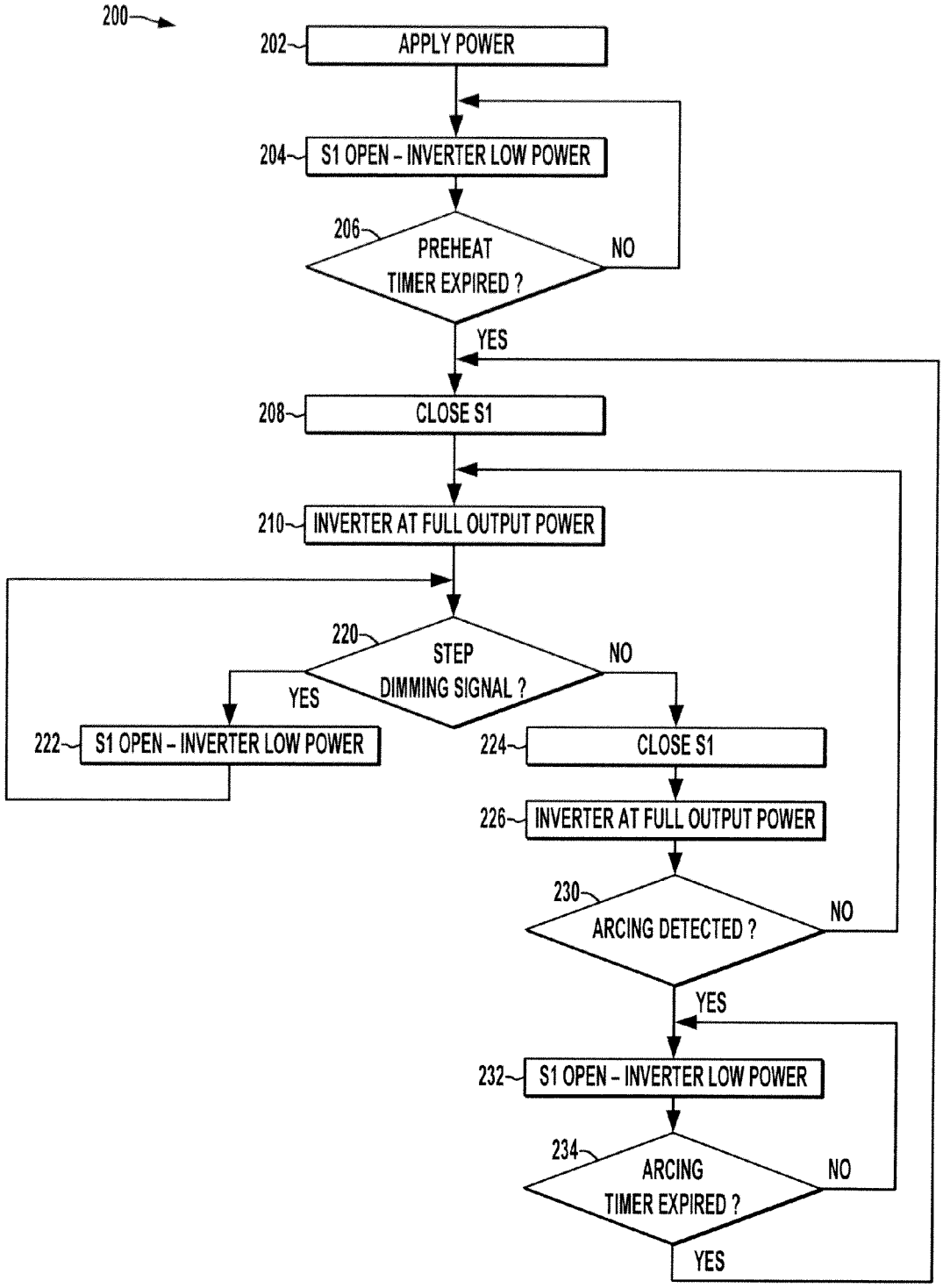
FIG. 2 is a flow diagram illustrating operation of the exemplary mode control circuit in accordance with further aspects of the disclosure.

FIG. 2 illustrates a process 200 for operation of the exemplary mode control circuit 150 of the ballast 100, beginning at 202 when power is applied to the circuit 100. At 204, the mode control switching device S1 is opened for low inverter power operation to both provide preheating current to secondary windings T2S and to hold the inverter 108 at a low power setting to avoid starting the lamps 110. A determination is made at 206 as to whether the preheating time has expired (e.g., timer 152 in FIG. 1). If not (No at 206), the operation remains in the second mode. Once the preheating time is done (YES at 206), the switch S1 is closed at 208 and the inverter 108 provides full output power at 210.

With the ballast 100 at full power, a determination is made at 220 as to whether a step dimming signal or command has been received (e.g., dimming circuit 154). If so (YES at 220), S1 is opened at 222 to reduce the output power for dimming the lamps 110. The process 200 continues monitoring the step dimming signal, and once this is removed (NO at 220), S1 is closed to switch to provide full output power at 226.

A determination is made at 230 as to whether arcing has been detected (e.g., by detection circuit 160 in FIG. 1). If not, the process 200 returns to again check for dimming control signals at 220 as described above. If arcing is detected (YES at 230), the mode control switch S1 is closed at 232 to set the inverter to low power operation and the expiration of the arcing timer (timer 156 in FIG. 1) is checked at 234, If the arc extinguishment time has not yet elapsed (NO at 234), the operation remains in the second mode with the switch S1 open. Once the anti-arcing time has elapsed (YES at 234), the process returns to 208, 210 described above to return the inverter 108 to mil output power.

Figure 3:
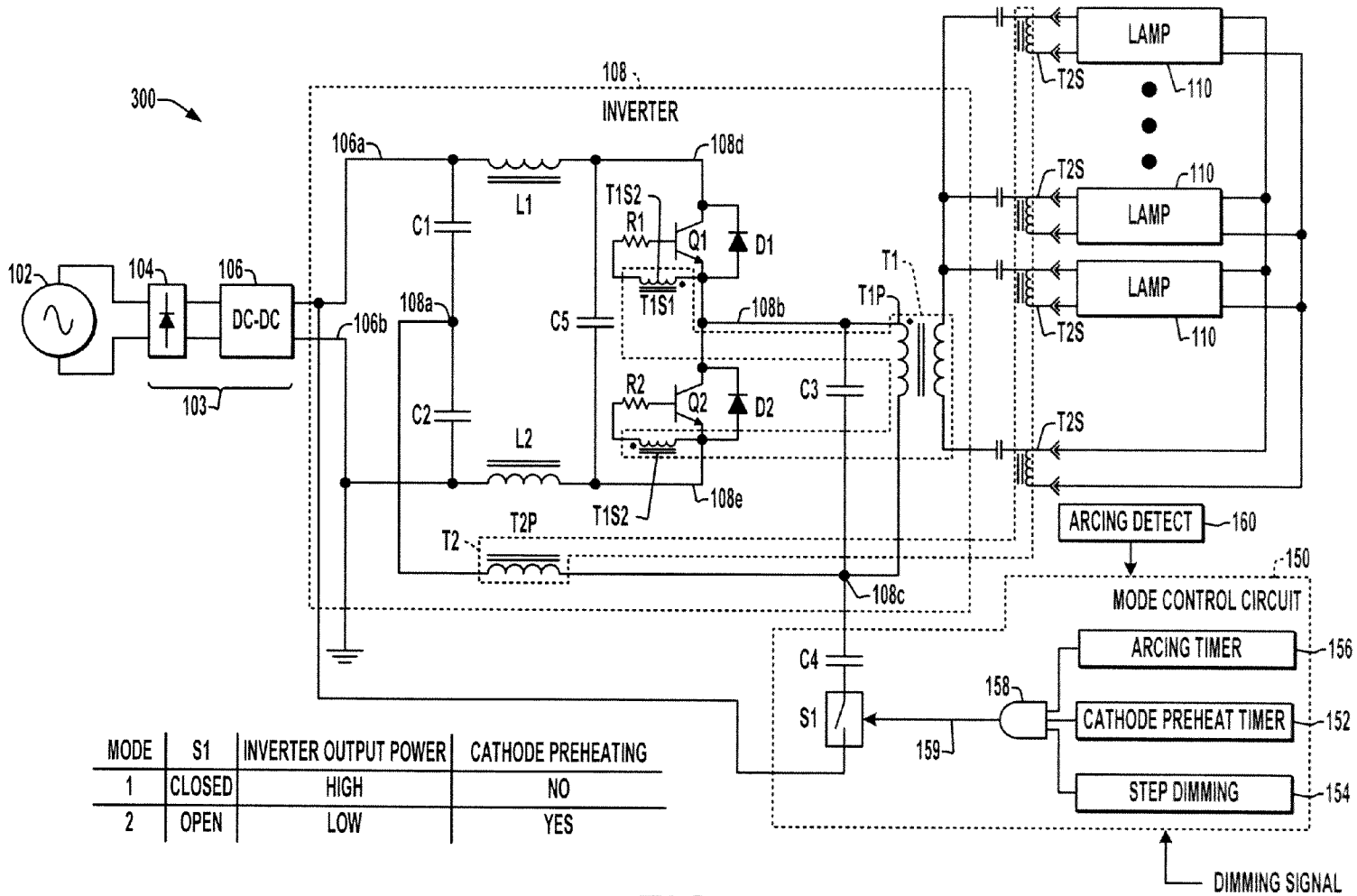
FIG. 3 is a schematic diagram illustrating another exemplary program, start ballast with a mode control circuit that selectively changes an inverter resonant frequency for cathode preheating, step dimming and/or for extinguishing detected arcs.

FIG. 3 illustrates another exemplary programmed start ballast 300 having an input DC circuit 103 providing a DC output at terminals 106*a* and 106*b*, as well as an inverter 108 converting the input DC to high-frequency AC output power to drive one or more lamps 110, and a mode control circuit 150 as described above in connection with the embodiment of FIG. 1. In the ballast 300 of FIG. 3, the mode control switch S1 is connected between capacitor C4 and the upper DC output terminal 106*a*, rather than to the grounded second terminal 106*b* as in FIG. 1.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software, or combinations thereof, which performs the specified function of the described component (i.e., that is functionally equivalent), even though not structurally equivalent to the disclosed structure which performs the function in the illustrated implementations of the disclosure. Although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

The following is claimed:

1. A programmed start ballast circuit for powering at least one light source, the ballast circuit comprising:

a DC circuit operative to provide a DC output at first and second DC output terminals;

an inverter circuit operatively coupled to the DC circuit to convert the DC output to produce an AC output to power at least one light source, the inverter comprising:

a first capacitance and a second capacitance coupled in series between the first and second DC output terminals and joined with one another at a first intermediate node, a first switching device and a second switching device coupled in series between the first and second DC output terminals and joined with one another at a second intermediate node, and a first transformer with a first primary winding coupled between the second intermediate node and a third intermediate node;

a second transformer with a second primary winding coupled between the first and third intermediate nodes; and a mode control circuit operative in a first mode to selectively couple the third intermediate node with one of the first and second DC output terminals to reduce a voltage potential across the second primary winding, and in a second mode to disconnect the third intermediate node from the second DC output terminal.

2. The ballast circuit of claim 1, where the mode control circuit comprises a fourth capacitance and a switching device coupled in series with one another between the third intermediate node and the second DC output terminal, the switching device being conductive in the first mode and non-conductive in the second mode.

3. The ballast circuit of claim 2, where the second transformer comprises at least one secondary winding operative to heat a cathode of the at least one light source when a voltage is applied across the second primary winding, the ballast circuit further comprising a preheat timer operative to provide a signal to hold the mode control circuit in the second mode for a predetermined preheat time following powerup of the ballast circuit to cause preheating of the light source cathode and to allow the mode control circuit to switch to the first mode after the predetermined preheat time to end preheating of the light source cathode.

4. The ballast circuit of claim 3, where the mode control circuit is selectively operative in response to a dimming signal after the predetermined preheat time to switch from the first mode to the second mode for dimmed operation.

5. The ballast circuit of claim 4, where the mode control circuit is selectively operative in response to an arcing detect signal after the predetermined preheat time to switch from the first mode to the second mode for a predetermined arcing time to extinguish a detected arcing condition and to thereafter switch from the second mode to the first mode.

6. The ballast circuit of claim 3, where the mode control circuit is selectively operative in response to an arcing detect signal after the predetermined preheat time to switch from the first mode to the second mode for a predetermined arcing time to extinguish a detected arcing condition and to thereafter switch from the second mode to the first mode.

7. The ballast circuit of claim 2, where the mode control circuit is selectively operative in response to an arcing detect signal to switch from the first mode to the second mode for a predetermined arcing time to extinguish a detected arcing condition and to thereafter switch from the second mode to the first mode.

8. The ballast circuit of claim 7, where the mode control circuit is selectively operative in response to an arcing detect signal to switch from the first mode to the second mode for a predetermined arcing time to extinguish a detected arcing condition and to thereafter switch from the second mode to the first mode.

9. The ballast circuit of claim 2, where the mode control circuit is selectively operative in response to an arcing detect signal to switch from the first mode to the second mode for a predetermined arcing time to extinguish a detected arcing condition and to thereafter switch from the second mode to the first mode.

10. The ballast circuit of claim 2, where operation of the switching device in the first mode reduces the voltage potential across the second primary winding to zero to reduce a resonant frequency of the inverter circuit.

11. The ballast circuit of claim 10, where the fourth capacitance is coupled between the third intermediate node and the switching device, and where the switching device is coupled between the fourth capacitance and the second DC output terminal.

12. The ballast circuit of claim 11, where the second DC output terminal is connected to a circuit ground.

13. The ballast circuit of claim 1, where the mode control circuit is operative in the first mode to reduce the voltage potential across the second primary winding to zero to reduce a resonant frequency of the inverter circuit.

14. The ballast circuit of claim 1, where the second transformer comprises at least one secondary winding operative to heat a cathode of the at least one light source when a voltage is applied across the second primary winding, the ballast circuit further comprising a preheat timer operative to provide a signal to hold the mode control circuit in the second mode for a predetermined preheat time following powerup of the ballast circuit to cause preheating of the light source cathode and to allow the mode control circuit to switch to the first mode after the predetermined preheat time to end preheating of the light source cathode.

15. The ballast circuit of claim 1, where the mode control circuit is selectively operative in response to a dimming signal to switch from the first mode to the second mode for dimmed operation.

16. The ballast circuit of claim 1, where the mode control circuit is selectively operative in response to an arcing detect signal time to switch from the first mode to the second mode for a predetermined arcing time to extinguish a detected arcing condition and to thereafter switch from the second mode to the first mode.

17. A programmed start ballast circuit, comprising:

an inverter circuit having a resonant circuit and operative to produce an AC output to power at least one light source at a first output power level in a first mode or to power the at least one light source at a second lower output power level in a second mode, the inverter comprising:

first and second DC input terminals, a first capacitance and a second capacitance coupled in series between the first and second DC input terminals and joined with one another at a first intermediate node, a first switching device and a second switching device coupled in series between the first and second DC input terminals and joined with one another at a second intermediate node, and a first transformer with a first primary winding coupled between the second intermediate node and a third intermediate node;

a second transformer with a second primary winding coupled between the first and third intermediate nodes;

a preheat circuit operative in the second mode to provide heat to at least one light source cathode; and a mode control circuit comprising a switching device operative according to a mode control input to set the inverter circuit in the first mode or the second mode using two equal potential nodes to change an impedance of the inverter resonant circuit, the mode control circuit operative in the first mode to cause the switching device to selectively couple the third intermediate node with one of the first and second DC input terminals to reduce a voltage potential across the second primary winding, and in the second mode to disconnect the third intermediate node from the one of the first and second DC input terminals.

18. The ballast circuit of claim 17, further comprising a preheat timer operative to provide a signal to hold the mode control circuit in the second mode for a predetermined preheat time following powerup of the ballast circuit to cause preheating of the light source cathode and to allow the mode control circuit to switch to the first mode after the predetermined preheat time to end preheating of the light source cathode.

19. The ballast circuit of claim 17, where the mode control circuit is selectively operative in response to a dimming signal to switch from the first mode to the second mode for dimmed operation.

20. The ballast circuit of claim 17, where the mode control circuit is selectively operative in response to an arcing detect signal to switch from the first mode to the second mode for a predetermined arcing time to extinguish a detected arcing condition and to thereafter switch from the second mode to the first mode.

* * * * *